US005865392A

United States Patent [19]

Blount et al.

[11] Patent Number: 5,865,392

[45] Date of Patent: Feb. 2, 1999

[54] COILED-TUBING REEL HAVING A MECHANICAL RESTRAINT

[75] Inventors: Curtis G. Blount, Wasilla, Ak.; Bruce E. Smith, East Wenatchee, Wash.

[73] Assignee: Atlantic Richfield Company, Los Angeles, Calif.

[21] Appl. No.: 62,570

[22] Filed: Apr. 20, 1998

[51] Int. Cl.[6] ..... E21B 33/00

[52] U.S. Cl. ..... 242/597.2; 242/157.1; 166/77.2

[58] Field of Search ..... 242/157.1, 396.5, 242/396.6, 397.2, 397.3, 419, 422.5, 580; 166/77.2

[56] References Cited

U.S. PATENT DOCUMENTS

| | | | |
|---|---|---|---|
| 3,182,961 | 5/1965 | Le Bus, Sr. | 242/396.6 |
| 3,982,402 | 9/1976 | Lang et al. | 242/397.3 |
| 4,015,798 | 4/1977 | Benya | 242/157.1 |
| 4,381,852 | 5/1983 | Ferree et al. | 242/157.1 |
| 4,685,516 | 8/1987 | Smith et al. | 166/65.1 |
| 4,795,108 | 1/1989 | Appling | 242/157.1 |
| 4,827,752 | 5/1989 | Alcock et al. | 242/157.1 |
| 5,002,238 | 3/1991 | Inhofer et al. | 242/157.1 |
| 5,090,039 | 2/1992 | Gard et al. | 378/59 |
| 5,183,218 | 2/1993 | Gavagna | 242/397.3 |
| 5,291,947 | 3/1994 | Stracke | 166/187 |

FOREIGN PATENT DOCUMENTS

| | | | |
|---|---|---|---|
| 55-145968 | 11/1980 | Japan | 242/157.1 |
| 1326526 A1 | 7/1987 | U.S.S.R. | 242/397.2 |

*Primary Examiner*—John P. Darling
*Attorney, Agent, or Firm*—Drude Faulconer

[57] ABSTRACT

A coiled-tubing system having a reel onto which steel tubing is wound in layered coils. A layon roller comprised of a compliant material is maintained in physical contact with the tubing on the reel to prevent premature unwinding of the tubing during operation. The roller is moved towards and away from the tubing to maintain the roller in contact with the tubing as it is payed out and reeled onto the reel. The system includes a level wind mechanism having a means therein for adjusting the tension in the tubing as it passes through the level wind mechanism.

7 Claims, 2 Drawing Sheets

COILED-TUBING REEL HAVING A MECHANICAL RESTRAINT

TECHNICAL FIELD

The present invention relates to a system for paying out and reeling in coiled tubing and in one aspect relates to a coiled-tubing system wherein the reel on which the coiled-tubing is wound has a layon roller mechanism or restraint for preventing the coiled-tubing from becoming prematurely unwound during operation.

BACKGROUND

"Coiled tubing" is now routinely used as a workstring in carrying out various operations in certain wellbores. As commonly used in the art, the term "coiled-tubing" or "reeled tubing" refers to a long, continuous length of a relatively small-diameter, thin-walled steel tubing which is wound onto and off of a large-diameter reel. The reel, in turn, can be mounted onto a trailer or the like so that it can be moved from site to site when needed. Once the reel is positioned at a work site (e.g. a wellhead), the continuous tubing is paid off the reel and down the well to carry out the desired operation (e.g. treating a formation, washing a liner, drilling a lateral wellbore, etc.). Upon completion of the operation, the coiled tubing is withdrawn and rewound onto the reel for reuse as needed.

In a typical, coiled-tubing application, the tubing is fed from the reel and through a relatively large-diameter guide arch to an injector head or the like which, in turn, grips the tubing and spools it on or off the reel while at the same time physically feeding it into or out of the wellbore. It is important to maintain the tubing in a proper arch between the reel and the injector head in order not to crimp or otherwise damage the tubing and to insure smooth feeding of the tubing. To do this, the tubing is usually passed over a large-diameter guide or a "gooseneck" which is positioned between the reel and the injector head to control the bending of the tubing.

Further, it is important to keep the coiled-tubing properly wound in layered coils on the reel during operation and prevent it from prematurely unwinding. That is, steel tubing resists coiling and will "unwind" if left unrestrained much in the same manner as does a tightly-wound mainspring of a watch. Therefore, if the coiled-tubing is not properly constrained on the reel, it is likely to prematurely "unwind" or "spring" the coils of tubing into disarray on the reel thereby causing damage and/or substantial delays while the tubing has to be untangled and rewound onto the reel. Most known coiled-tubing systems restrain the tubing on the reel and prevent it from prematurely "unwinding" by adjusting the tension of the tubing on the reel against the force from an injector while spooling the tubing or by a mechanical braking mechanism or the like during transit and/or non-use.

SUMMARY OF THE INVENTION

The present invention provides a coiled-tubing system which includes a means for maintaining the tubing in layered coils on a reel while the tubing is being payed out or reeled onto the reel. This prevents the tubing from prematurely unwinding during operations which, in turn, would cause damage and/or significant delays while the tubing was "untangled" and rewound onto the reel.

More specifically, the present invention provides a coiled-tubing system having a reel onto which a long continuous length of steel tubing is wound in layered coils. A layon roller is provided which maintains physical contact with the layered coils of tubing at all times during which the tubing is being reeled onto or off the reel. The layon roller is comprised of a compliant element such as an inflatable member (e.g.. pneumatic tire) whereby the roller will comply with the contour of the layered coils as the tubing is payed out of rewound onto the reel to keep the tubing from prematurely unwinding.

The system includes means (e. g.. hydraulic or pneumati-coperated cylinders or the like) for moving the roller towards and away from the tubing on the reel so that the roller will remain in contact with the tubing as it is payed out and reeled onto the reel. Further, the system includes a level wind mechanism similar to that found in prior art units of this type except the present level wind mechanism includes a means for tensioning the tubing as it is wound onto the reel. Level wind mechanism is comprised of a housing through which the tubing passes as it leaves or enters onto the reel, depending on the operation being performed. The housing has a compressible means (e.g.. packing) positioned therein around the tubing and has a means for adjusting the compression of the packing to thereby adjust the tension in the tubing as it passes through the housing.

By using the layon roller to maintain the tubing in layered coils on the reel during operation and to prevent the tubing from prematurely unwinding, certain advantages may be realized over the known prior-art systems of this type. For example, the overall weight of the coiled-tubing system can be reduced from known conventional systems in that the "gooseneck" and any additional gripper-style injector assembly adjacent the reel, which may be required in some prior-art systems, can be eliminated in most applications. Also, by being able to maintain the coiled-tubing in a gentle curvature between the reel and the injector unit without the need for the tubing to undergo any severe bending, the number of in-and-out cycles of a string of coiled-tubing is increased thereby significantly increasing the operational life of the tubing.

BRIEF DESCRIPTION OF THE DRAWINGS

The actual construction, operation, and apparent advantages of the present invention will be better understood by referring to the drawings which are not necessarily to scale and in which like numerals identify like parts and in which.

BEST KNOWN MODE FOR CARRYING OUT THE INVENTION

Figure 1:
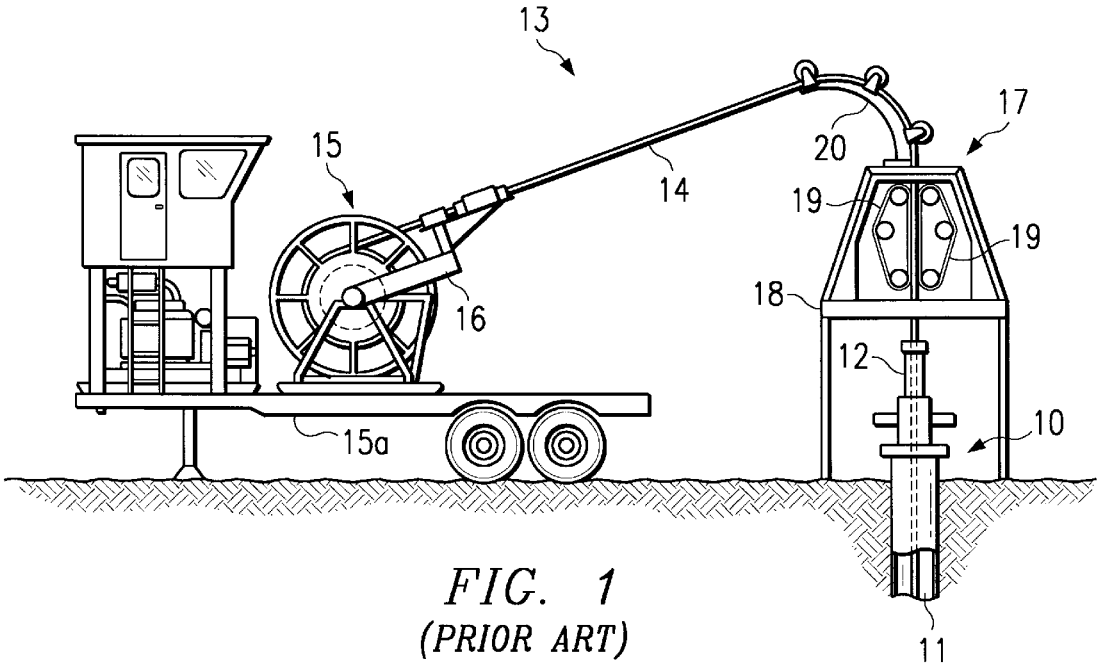
FIG. 1 (PRIOR ART)
FIG. 1 is an elevational view, partly in section, of a typical coiled-tubing injector unit in accordance with the prior art in position at a wellhead.

Referring now to FIG. 1, there is illustrated a well 10 having a cased wellbore 11 and a wellhead 12. A typical, prior-art, coiled tubing system 13 has been positioned at well 10 for injecting and withdrawing a workstring comprised of coiled-tubing 14 down the wellbore 11 through wellhead 12. As will be understood in the art, the term "coiled-tubing", as used herein, is a continuous length of a relatively small diameter (e.g. ¾–3½ inch and even up to 6-inch in certain pipeline application), thin-walled metal tubing (e.g. steel or other high-strength, alloy tubing such as titanium alloy) 14 which can be wound or coiled onto reel or spool 15 which, in turn, is mounted on a mobile trailer 15*a* or the like. Reel 15 includes a "level wind" mechanism 16 or the like which moves back and forth across the reel to align the continuous length of tubing in relatively uniform layers as the tubing is reeled onto or off of reel 15.

Tubing 14 is lowered into and withdrawn from wellbore 11 by a tubing injection unit 17 of a type which is commercially-available from various suppliers (e.g. Hydra-Rig, Fort Worth, Tex.). Injection unit 17 is suitably mounted above wellhead 12 on a portable support structure 18 and typically includes a pair of opposed, endless chain means 19 which are driven in a timed relationship to grip tubing 14 and forcibly inject or withdraw the tubing into or out of well 10 depending on the direction in which the chains are driven. A guide member or "gooseneck" 20 is mounted on tubing injection unit 17 for guiding or "bending" the tubing 14 through a relatively severe curvature as it enters the injection unit 17. As will recognized by those skilled in the art, this relatively short bending into the injector unit 17 during each in-and-out cycle of the tubing significantly reduces the life of the same.

In coiled-tubing systems such as that described above, it is vital that the coiled-tubing 14 remains in aligned, layered coils on reel 15 as it is fed onto or retrieved from the reel. As will be understood, this is necessary to insure that the entire length of tubing 14 can be neatly stored on the reel and that it can easily be fed and/or retrieved therefrom without crimping, binding, jamming, or otherwise damaging the tubing. Due to the inherent properties of steel tubing, the tubing resists being formed into a coil and will spring back if not constrained once coiled onto reel 15. In prior-art, coiled-tubing systems such as system 13 of FIG. 1, the coiled-tubing 14 is maintained or constrained on reel 15 by controlling the tension on reel 14 while applying an opposite force through an injector or mechanical braking system on the level wind mechanism (not shown).

Referring again to the drawings, FIGS. 2–5 disclose a coiled-tubing system 30 in accordance with the present invention wherein the coiled-tubing is constrained in its coiled configuration on the reel by means of a lay-on roller which is in physical contact with the tubing on the reel. More specifically, system 30 is comprised of reel 31 having an axle 32 which, in turn, is rotatably mounted on support 33 which, in turn, is affixed on platform 34 or the like. As will be understood in the art, platform 34 can be carried on or may actually form a part of a trailer or the like (not shown), if desired, whereby reel 31 can easily be moved from site to site.

As shown, axle 32 has a gear 32*a* or the like affixed to one end which is adapted to be driven by a source (not shown) to thereby rotate reel 31 at a desired rate as coiled tubing 36 is reeled onto or off of reel 31, as will be understood. Other types of drive mechanisms can be used without departing from the present invention. A swivel inlet 32*b* may be fluidly connected through the other end (FIG. 4) of axle 32 for supplying fluid or the like into coiled-tubing 36 from conduit 32*c* as is common in coiled-tubing reels of this general type. Further, a wireline swivel or the like (not shown) may be provided on the other end of axle 32 as will be understood.

A level wind mechanism 35 is provided for aligning coiled-tubing 36 into layered coils as the tubing is reeled onto or off of reel 31. As best seen in FIG. 4, level wind mechanism 35 is comprised of a follower 37 which is driven back and forth across reel 31 by a reversing-thread, lead screw 38. Also, other mechanisms may used for coiling the tubing in neat layers in place of screw 38 without departing from the present invention; e.g. a rack-and-pinion mechanism; sprockets and chain, etc.. Screw 38 is rotatably mounted between the free ends of arms 40 which, in turn, are pivotably mounted at their other ends 41 (e.g. to support 33, FIG. 3). Screw 38 has a gear 39 or the like at one end which, in turn, is adapted to be driven by a source (not shown) to rotate screw 38 and move follower 37 back and forth across reel 31, as will be understood.

Fluid-actuated cylinders 42 or the like are positioned between support 33 and respective arms 40 whereby arms 40 can be rotated about their pivots 41 to thereby adjust the position of level wind mechanism 35 as will be explained in more detail below. Follower 37 is preferably comprised of a housing having a chamber 37*a* formed therein through which coiled-tubing 36 passes. Packing 43 or the like is positioned within the chamber and engages a portion of tubing 36 as the tubing passes through the follower. Packing 43 is compressible to thereby adjust the resistance against the tubing as it passes through the follower, for a purpose discussed below. As shown, the means for adjusting the compression of packing 43 is comprised of a piston 44 which is activated by fluid through inlet 45 however, it should be recognized that other means can be used to apply a variable resistance against the tubing as it passes through the follower.

Figure 2:
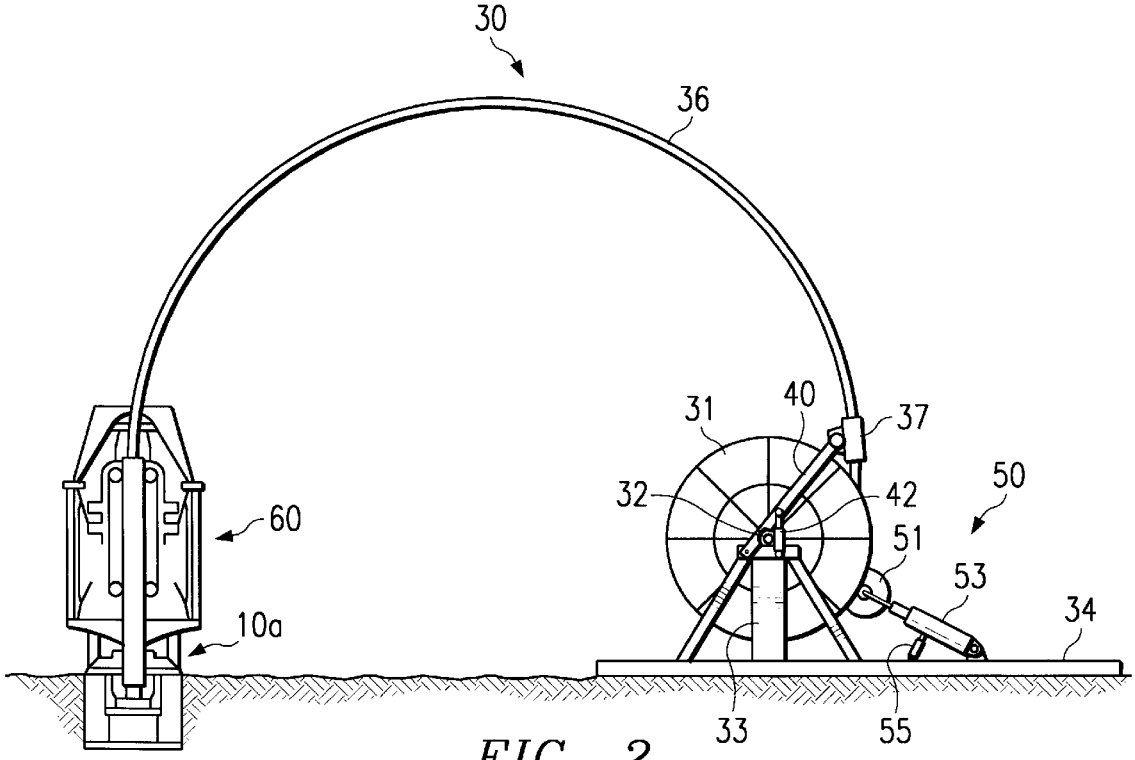
FIG. 2 is an elevational view, partly in section of the coiled tubing unit in accordance with the present invention in position at a well head.
Figure 3:
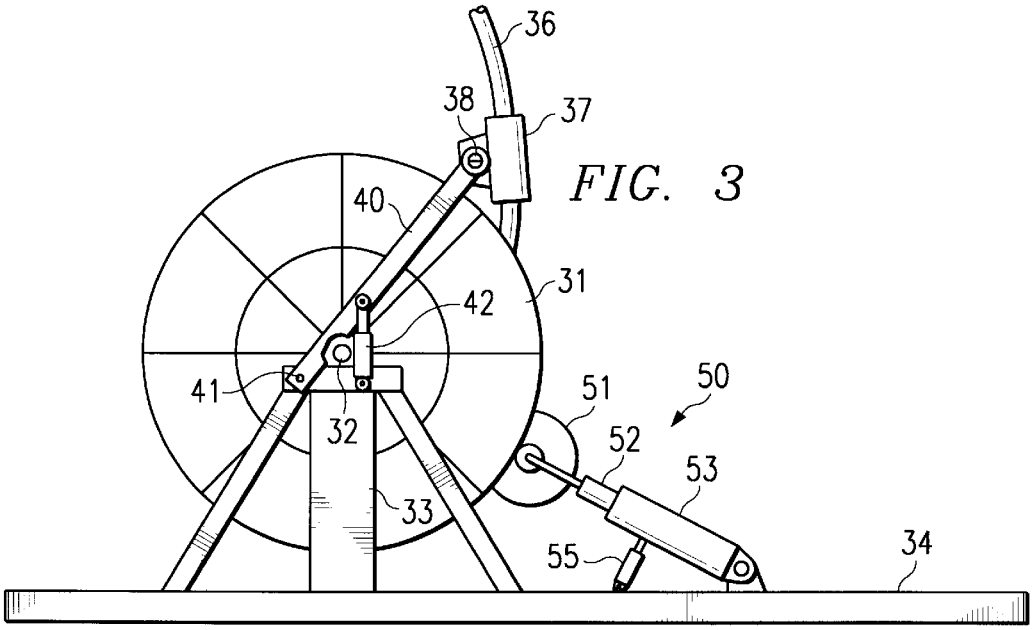
FIG. 3 is an enlarged, elevational view of the coiled tubing reel and tubing restraint mechanism of FIG. 2.
Figure 4:
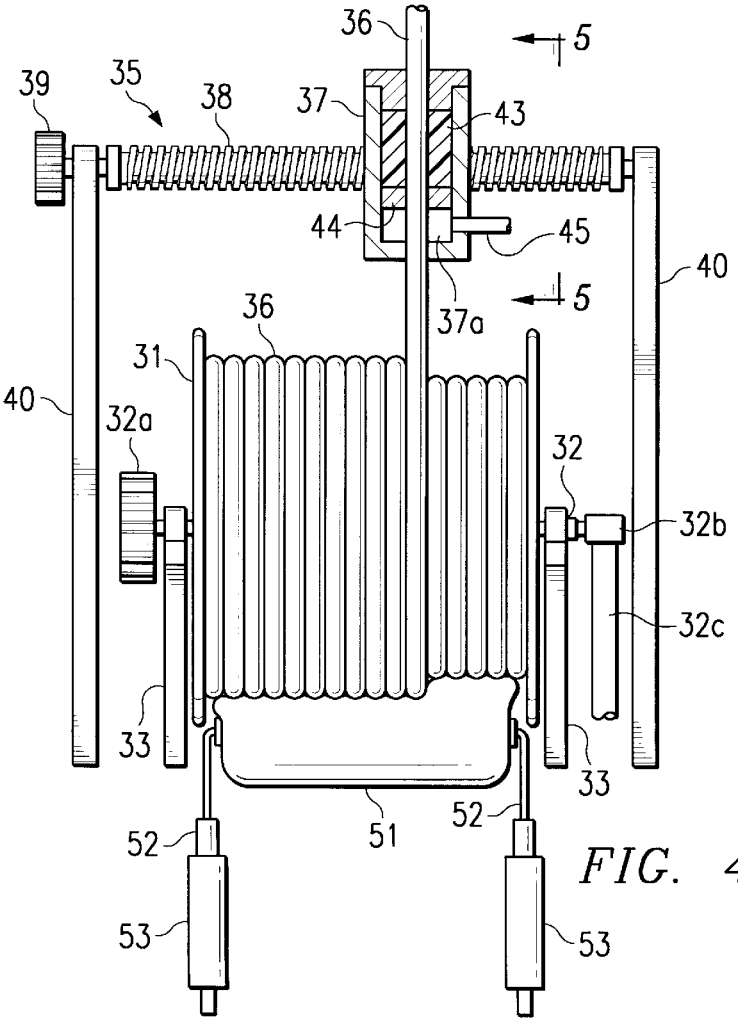
FIG. 4 is a back view, partly in section, of the coiled tubing reel and tubing restraint mechanism of FIG. 3.
Figure 5:
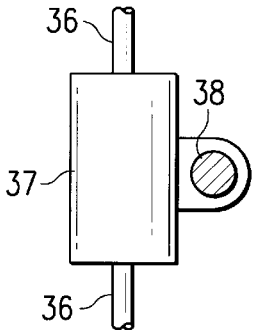
FIG. 5 is a sectional view, partly broken away, taken along line 5—5 of FIG. 4.

To prevent tubing 36 from unwinding or spring off reel 31 like a sprung mainspring in a watch, a lay-on roller mechanism 50 is positioned adjacent reel 31 as shown in FIGS. 2 and 3. Lay-on roller mechanism 50 is comprised of a compliant roller 51 which is rotatably mounted on one end of piston rod 52 of an actuating means (e.g. fluid-actuated cylinder 53 or the like) which, in turn, is pivotably mounted to platform 34. As can be seen, by extending or retracting rod 52, roller can be moved towards or away from reel 31. A means (e.g. hydraulic cylinder 55) is positioned between actuating means 53 and platform 34 to adjust the relative vertical position of roller 51 with respect to reel 31. Preferably, roller 51 is compliant (e.g. a pneumatic tire or the like) so that it will readily conform to the contour of the layer coiled-tubing on reel 31 at any time during operation (see FIG. 4).

In operation, platform 34 is positioned on site and the free end of coiled-tubing 36 is passed through a relatively-large diameter arch into and through injection unit 60 which, in turn, has been positioned at the wellhead of well 10*a*. The compression of packing 43 in follower 37 is adjusted to maintain the desired tension and arch between reel 31 and injection unit 60 as the coiled-tubing is reeled back onto reel 31. Also, means 55 is actuated to position lay-on roller 51 with respect to the coiled tubing 36 on reel 31 and cylinders 53 are actuated to move lay-on roller into physical contact with the layer coiled tubing 36.

Injector unit 60 is then actuated to pull the tubing from the reel as the reel is rotated through gear 32*a* on axle 32 in a timed relation to thereby maintain the desired, relatively gentle and smooth curvature of the tubing between the reel and the injector. By maintaining such an arc, the coiled-tubing does not have to undergo severe curvatures or bending which, in turn, will significantly increase the operational life of the tubing. As tubing 36 is unreeled, cylinders 53 are actuated to move lay-on roller 51 forward to maintain contact with the tubing 36 left on reel 31. The operation described above is simply reversed to rewind the tubing onto reel 31.

What is claimed is:

1. A coiled-tubing system comprising:

a reel;

a continuous length of metal tubing coiled onto said reel; and a layon roller comprised of a compliant element in physical contact with said tubing coiled on said reel for maintaining said tubing in layered coils as said tubing is reeled onto or off of said reel.

2. The coiled-tubing system of claim 1 wherein said compliant element comprises:

an inflatable member.

3. The coiled-tubing system of claim 1 including:

means for moving said layon roller towards and away from said tubing coiled on said reel.

4. The coiled-tubing system of claim 3 wherein said means for moving said layon roller comprises:

at least one fluid-actuated cylinder.

5. The coiled-tubing system of claim 1 including:

a level wind mechanism for coiling said tubing into layered coils on said reel.

6. The coiled-tubing system of claim 5 wherein said level wind mechanism comprises:

a housing through which said tubing passes;

means for adjusting the tension on the tubing as it passes through said housing.

7. The coiled-tubing system of claim 6 wherein said means for adjusting the tension on said tubing comprises:

a compressible means in said housing and around said tubing; and means for adjusting the compression of said packing to thereby adjust the tension in said tubing as it passes through said housing.

* * * * *